US008262424B1

(12) United States Patent
Ross et al.

(10) Patent No.: US 8,262,424 B1
(45) **Date of Patent: *Sep. 11, 2012**

(54) SYSTEM AND RELATED METHODS FOR MARINE TRANSPORTATION

(76) Inventors: Anthony C. Ross, John's Island, SC (US); Russel Ross, Arlington, VA (US)

( * ) Notice: Subject to any disclaimer, the term of this patent is extended or adjusted under 35 U.S.C. 154(b) by 278 days.

This patent is subject to a terminal disclaimer.

(21) Appl. No.: 12/482,740

(22) Filed: Jun. 11, 2009

Related U.S. Application Data

(63) Continuation of application No. 10/926,627, filed on Aug. 25, 2004, now Pat. No. 7,547,199.

(60) Provisional application No. 60/497,806, filed on Aug. 25, 2003, provisional application No. 60/497,836, filed on Aug. 25, 2003.

(51) Int. Cl.

| | |
|---|---|
| ***B63H 11/00*** | (2006.01) |
| ***B63H 11/04*** | (2006.01) |
| ***B63H 11/107*** | (2006.01) |
| ***F04B 43/08*** | (2006.01) |
| ***F04B 43/10*** | (2006.01) |

(52) U.S. Cl. ..... 440/38; 440/40; 60/221; 417/478

(58) Field of Classification Search ..... 440/38, 440/40, 44, 47; 60/221, 222; 417/392, 394, 417/412, 472–475, 478

See application file for complete search history.

(56) References Cited

U.S. PATENT DOCUMENTS

| | | | |
|---|---|---|---|
| 1,546,973 | A | 7/1925 | Ellis |
| 2,056,475 | A | 10/1936 | Marx |
| 2,726,624 | A | 12/1955 | Raicy |
| 2,807,216 | A | 9/1957 | Bielstein |
| 2,815,715 | A | 12/1957 | Tremblay |
| 2,971,471 | A | 2/1961 | Huebschman |
| 3,048,121 | A | 8/1962 | Sheesley |
| 3,062,002 | A | 11/1962 | Schaffer |
| 3,074,351 | A | 1/1963 | Foster |
| 3,136,257 | A | 6/1964 | Smith et al. |
| 3,190,229 | A | 6/1965 | Turowski |
| 3,194,170 | A | 7/1965 | Ulbing |
| 3,215,084 | A | 11/1965 | Cline |
| 3,216,413 | A | 11/1965 | Mota |
| 3,307,358 | A | 3/1967 | Kerandraon |
| 3,359,735 | A | 12/1967 | Yeager, Sr. |
| 3,552,408 | A | 1/1971 | Dowdican |
| 3,677,667 | A | 7/1972 | Morrison |
| 3,765,175 | A | 10/1973 | Ohnaka |
| 3,783,453 | A | 1/1974 | Bolie |
| 3,826,217 | A | 7/1974 | Canova |
| 3,836,289 | A | 9/1974 | Wolford et al. |
| 3,839,983 | A | 10/1974 | McAusland |
| 3,945,201 | A | 3/1976 | Entringer |
| 4,026,235 | A | 5/1977 | Woodfill |
| 4,031,844 | A | 6/1977 | Onal et al. |
| 4,076,467 | A | 2/1978 | Persson |
| 4,284,902 | A | 8/1981 | Borgren et al. |

(Continued)

FOREIGN PATENT DOCUMENTS

| | | | |
|---|---|---|---|
| DE | 3004109 | A1 | 8/1981 |

(Continued)

*Primary Examiner* — Ajay Vasudeva
(74) *Attorney, Agent, or Firm* — Jonathan Spangler

(57) ABSTRACT

A system and related methods for manned and/or unmanned marine transportation involving equipping a vessel capable with a linear pump for propelling the vessel through or substantially over a body of water.

20 Claims, 7 Drawing Sheets

U.S. PATENT DOCUMENTS 4,350,478 A 9/1982 Oldershaw et al.
4,389,169 A 6/1983 De Deionigi
4,424,009 A 1/1984 van Os
4,439,112 A 3/1984 Kitsnik
4,449,893 A 5/1984 Beckman et al.
4,488,854 A 12/1984 Miller
4,541,891 A 9/1985 Leatherman
4,744,900 A 5/1988 Bratt
4,787,823 A 11/1988 Hultman
4,925,377 A 5/1990 Inacio et al.
5,085,563 A 2/1992 Collins et al.
5,108,426 A 4/1992 Biro et al.
5,209,654 A 5/1993 Lofsjogard Nilsson et al.
5,298,818 A 3/1994 Tada
5,327,041 A 7/1994 Culp
5,333,444 A 8/1994 Meng
5,401,195 A 3/1995 Yocom
5,411,381 A 5/1995 Perrodin
5,567,131 A 10/1996 McNaull
5,620,048 A 4/1997 Beauquin
5,676,162 A 10/1997 Larson, Jr. et al.
5,676,651 A 10/1997 Larson, Jr. et al.
5,693,091 A 12/1997 Larson, Jr. et al.
5,717,259 A 2/1998 Schexnayder
5,722,930 A 3/1998 Larson, Jr. et al.
5,758,666 A 6/1998 Larson, Jr. et al.
5,792,106 A 8/1998 Mische
5,879,375 A 3/1999 Larson, Jr. et al.
5,915,930 A 6/1999 McNaull
5,964,580 A 10/1999 Taga
6,000,353 A 12/1999 De Leu
6,012,910 A 1/2000 McNaull
6,050,787 A 4/2000 Hesketh
6,273,015 B1 8/2001 Motsenbocker et al.
6,273,771 B1 8/2001 Buckley et al.
6,318,237 B1 11/2001 Muller
6,352,455 B1 * 3/2002 Guagliano et al. ..... 440/38
6,464,476 B2 * 10/2002 Ross et al. ..... 417/478
6,547,749 B2 4/2003 Hansen
6,575,715 B1 6/2003 Rastegar
6,607,368 B1 * 8/2003 Ross et al. ..... 417/412
7,445,531 B1 * 11/2008 Ross et al. ..... 440/38
7,547,199 B1 * 6/2009 Ross et al. ..... 417/412
7,785,162 B1 * 8/2010 Ross et al. ..... 440/38
2002/0098098 A1 7/2002 Miesner
2002/0195252 A1 12/2002 Maguire et al.

FOREIGN PATENT DOCUMENTS

JP 53-115906 10/1978

* cited by examiner

-PRIOR ART-

SYSTEM AND RELATED METHODS FOR MARINE TRANSPORTATION

CROSS-REFERENCES TO RELATED APPLICATIONS

The present application is a continuation of U.S. patent application Ser. No. 10/926,627, filed on Aug. 25, 2004 and issued as U.S. Pat. No. 7,547,199 on Jun. 16, 2009 (the contents being incorporated herein by reference), which claims the benefit of priority under 35 U.S.C. §119(e) from U.S. Provisional Patent Application Ser. No. 60/497,806 filed Aug. 25, 2003 (the contents being incorporated herein by reference) and U.S. Provisional Patent Application Ser. No. 60/497,836 filed Aug. 25, 2003 (the contents being incorporated herein by reference). The present invention also incorporates by reference the complete disclosures of U.S. Pat. No. 6,352,455 to Guagliano et al., U.S. Pat. No. 6,607,368 to Ross et al., U.S. Pat. No. 7,445,531 to Ross et al. and U.S. patent application Ser. No. 12/264,906 filed by Ross et al. on Nov. 4, 2008.

BACKGROUND OF THE INVENTION

I. Field of the Invention

The present invention relates generally to marine transportation and, more particularly, to an improved system and related methods for manned and/or unmanned marine transportation.

II. Discussion of the Prior Art

Various challenges exist in creating unmanned transportation for marine applications. The present invention is directed at overcoming, or at least improving upon, the disadvantages of the prior art.

SUMMARY OF THE INVENTION

The present invention comprises a vehicle for unmanned marine transportation. According to one embodiment of the present invention, this is accomplished by equipping a marine vessel or boat with a bank of batteries to power the various systems on the vessel, a plurality of solar cells to augment and/or supplant the battery bank, a computer guidance system for guiding and operating the various systems on the vessel, an antenna for sending and/or receiving data or signals, a plurality of sensors for providing feedback or input to the various systems on the vessel, a motor capable of being swiveled between a stability-providing position and a drive position, and one or more rudders for steering the vessel.

In a preferred embodiment, the motor comprises a linear pump that produces power on all strokes and allows full six degrees of freedom (6DOF) vectoring for rapid and efficient directional control. There are very few parts thereby significantly reducing the maintenance, life cycle cost, energy consumption, weight, and volume. By way of example only, the linear pump may be of a type generally shown and described in U.S. Pat. Nos. 6,352,455 and 6,607,368, the entire contents of which are hereby incorporated into this disclosure as if set forth in their entirety herein.

In another embodiment of the present invention, the linear pump is similar to the linear pumps of the '455 and '368 patents in that it includes an inner chamber disposed within an outer chamber, each having one or more inlets and outlets for passing fluid into and out of each respective chamber to pump fluid. The linear pump of the present invention is different from (and improved relative to) the linear pump of the '455 and '368 patents in that the outer chamber and inner chamber are both generally rigid, wherein the circumference of the inner chamber may be adjusted via a plurality of generally rigid ribs and linear motors, and wherein the end plates do NOT move relative to one another. The linear pump of the present invention may find use in any number of fluid pumping and/or vehicle propulsion applications, including but not limited to pumping water, air, etc. . . . for any of a variety of marine, medical, industrial, governmental and/or recreational uses.

In one embodiment, the outer chamber of the linear pump is generally rigid, and includes a plurality of intake ports to permit fluid to enter into the outer chamber (including but not limited to one-way check valves) and a plurality of outlet ports to permit movement of the fluid or relative fluid of the device (including but not limited to one-way check valves). The inner chamber is constructed from a plurality of generally rigid plate members or "slat-like" ribs which run the length of the pumping system of the present invention. Each rib member cooperates with one or more linear motors such that the rib members may be selectively forced in a radial (i.e. outward) direction and medical (i.e. inward) direction.

To facilitate this radial and medial motion, each rib member is equipped with an articulating member which engages into a groove formed within an adjacent rib member and forms an articulated joint. As an example, both the rib members and the articulating members are generally curved such that the inner chamber is generally cylindrical. As the linear motors are operated, the rib members are caused to expand and contract within the generally rigid outer chamber. In a preferred embodiment, the linear motors include permanent magnets, but any of a variety of suitable linear drive mechanisms may be employed without departing from the scope of the present invention, including but not limited to hydraulic and pneumatic systems. To ensure no pressure loss during operation, the articulating member may be equipped with any of a variety of sealing feature, including but not limited to O-rings or the like to prevent the passage of fluid in between the adjacent rib members during contraction and/or expansion.

One advantage of this design is that, unlike the linear pump systems shown and described in the '455 or '368 patents, the inner chamber is not a bladder which will stretch and recover. The power is 90-degree opposition, which provides close to a 100% power exchange instead of the 70% with the flexible bladder of the '455 or '368 patents. This is a significant distinction in that it will allow the pump of the present invention, when attached to a vehicle or appropriate size and construction, to actually propel the vehicle from a position on top of or under the water to an airborne state out of the water.

In an alternative embodiment, the outer chamber of linear pump has inlets and outlets disposed along the outer periphery of the outer chamber. Each embodiment of the linear pump disclosed herein is capable of simultaneously discharging the fluid within the inner chamber while fluid is charged or delivered into the outer chamber according to the present invention. The inverse is also true, wherein the linear pump is capable of simultaneously discharging the fluid within the outer chamber while fluid is charged or delivered into the inner chamber according to the present invention.

Although described herein as suitable for unmanned use, it will be appreciated that the marine vessel of the present invention may also be equipped to be manned with one or more users.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein:

FIG. 5 is a cross-sectional view of the linear pump of FIG. 4 taken along line 4-4 in

FIG. 4;

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The linear pump of the present invention disclosed herein boasts a variety of inventive features and components that warrant patent protection, both individually and in combination.

Figure 1:
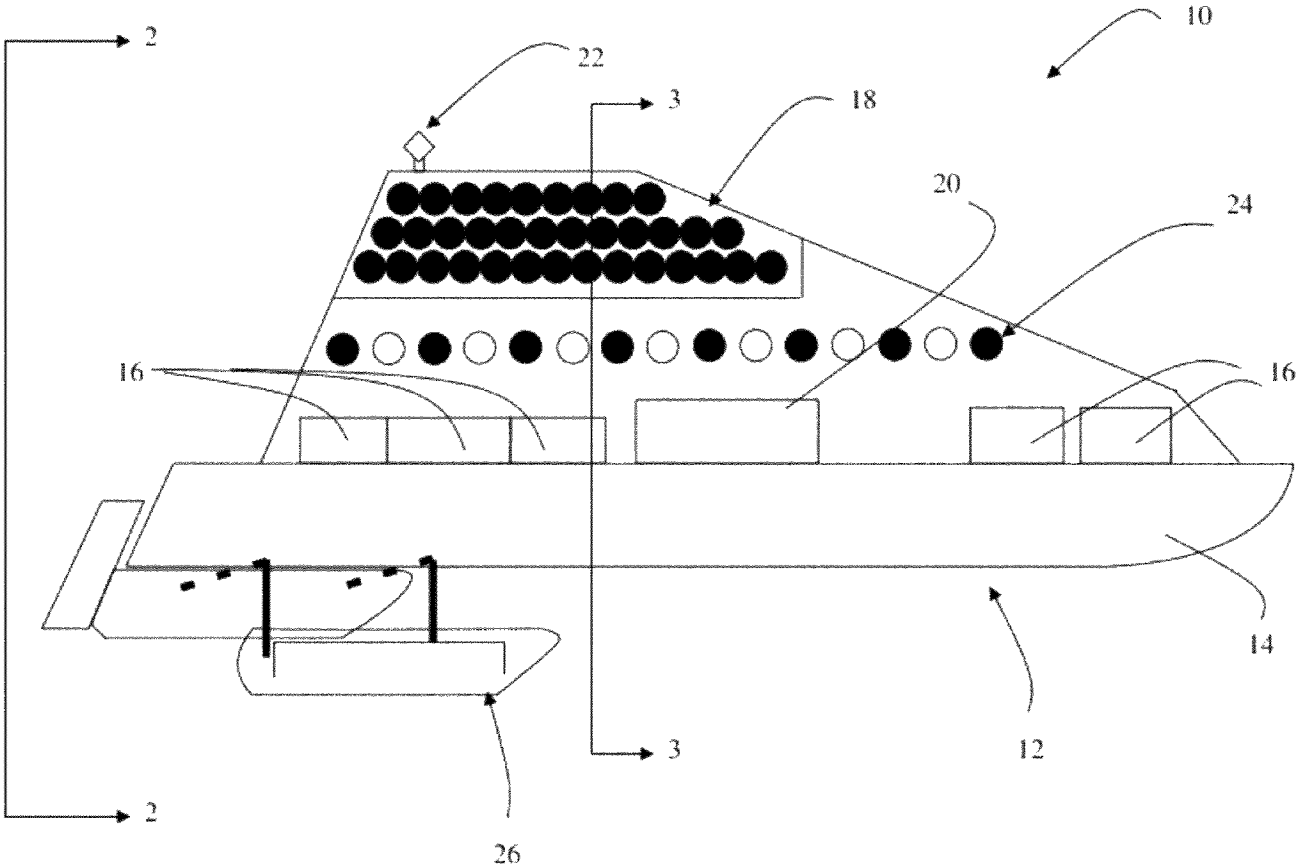
FIG. 1 is a side view of a marine transportation vehicle of the present invention.
Figure 2:
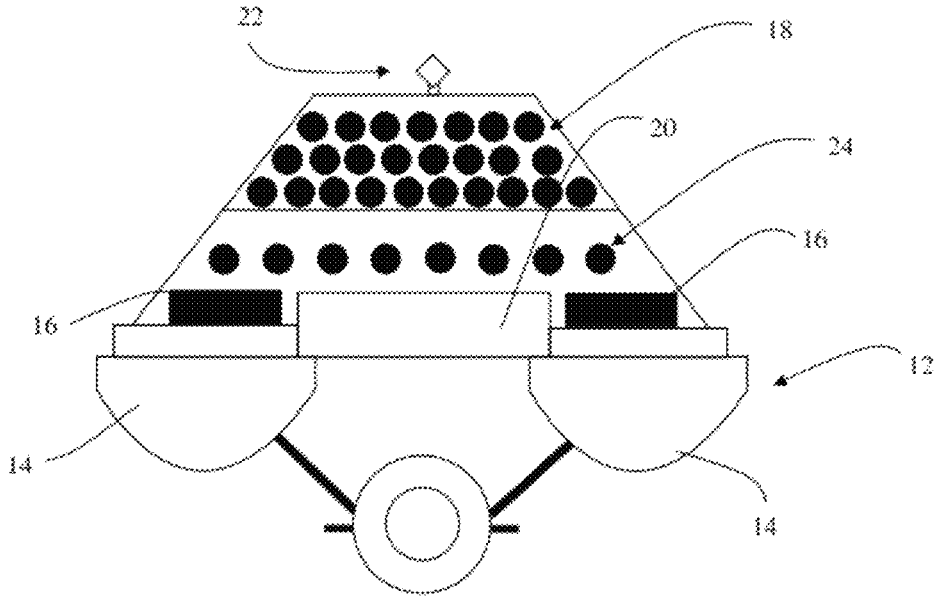
FIG. 2 is an end view of the marine transportation vehicle of the present invention taken along lines 2-2 in FIG. 1.
Figure 3:
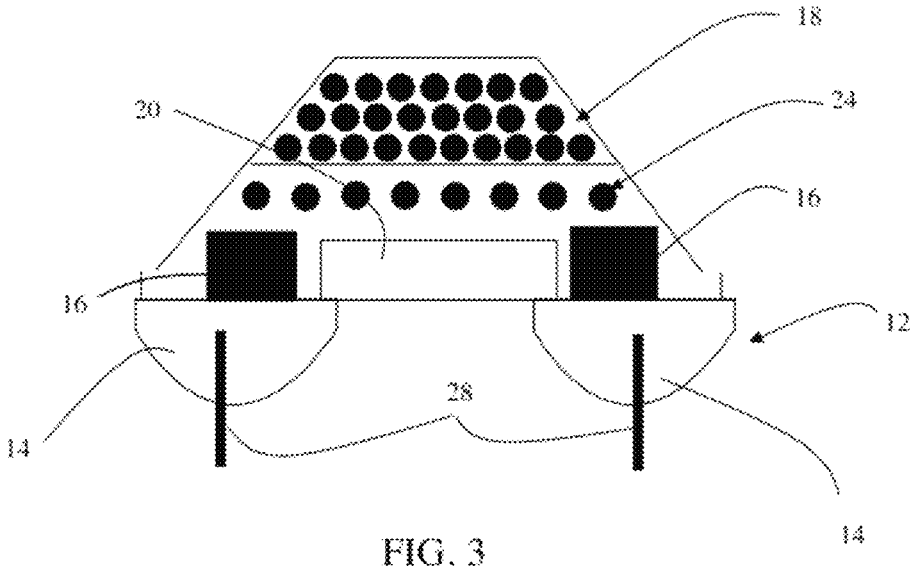
FIG. 3 is a partial sectional view of the marine transportation vehicle of the present invention taken along lines 3-3 in FIG. 1.
Figure 4:
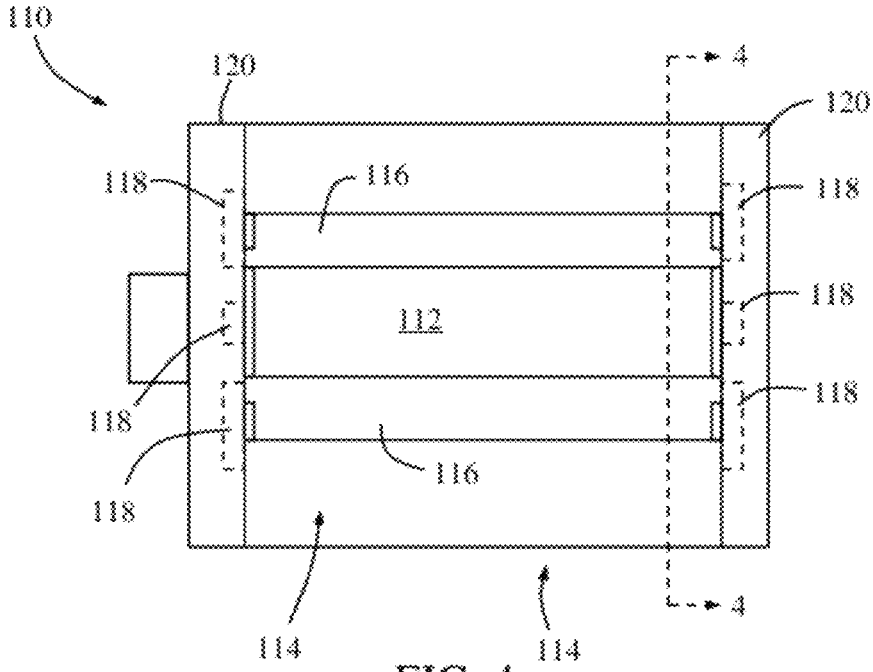
FIG. 4 is a side view of a linear pump according to one embodiment of the present invention.
Figure 5:
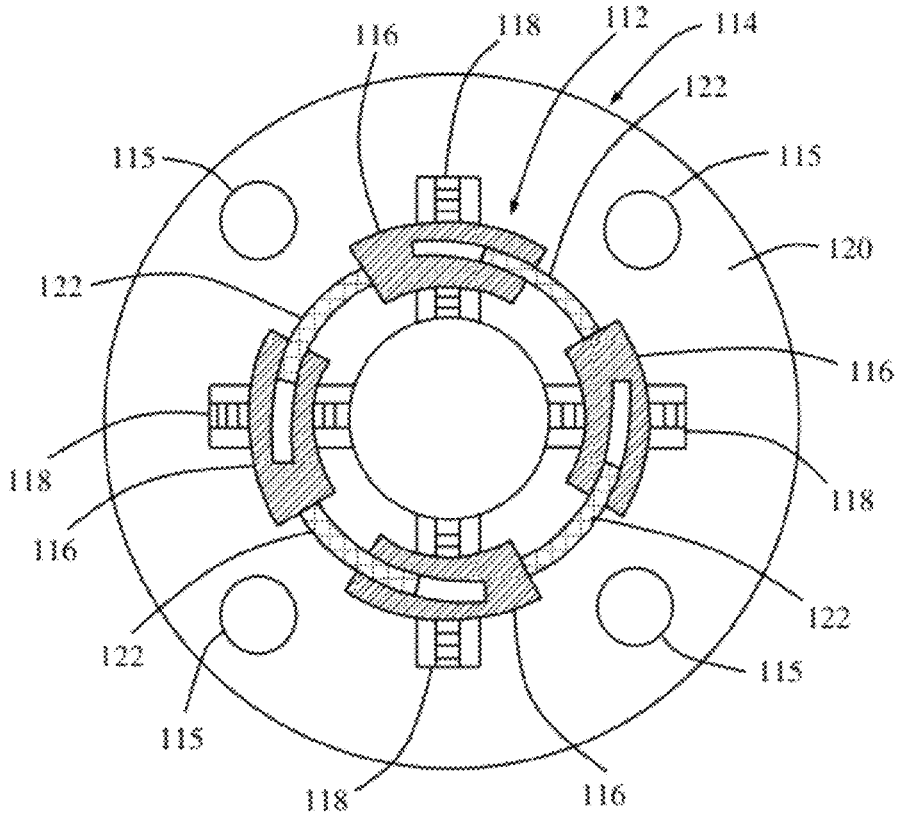
Figure 6:
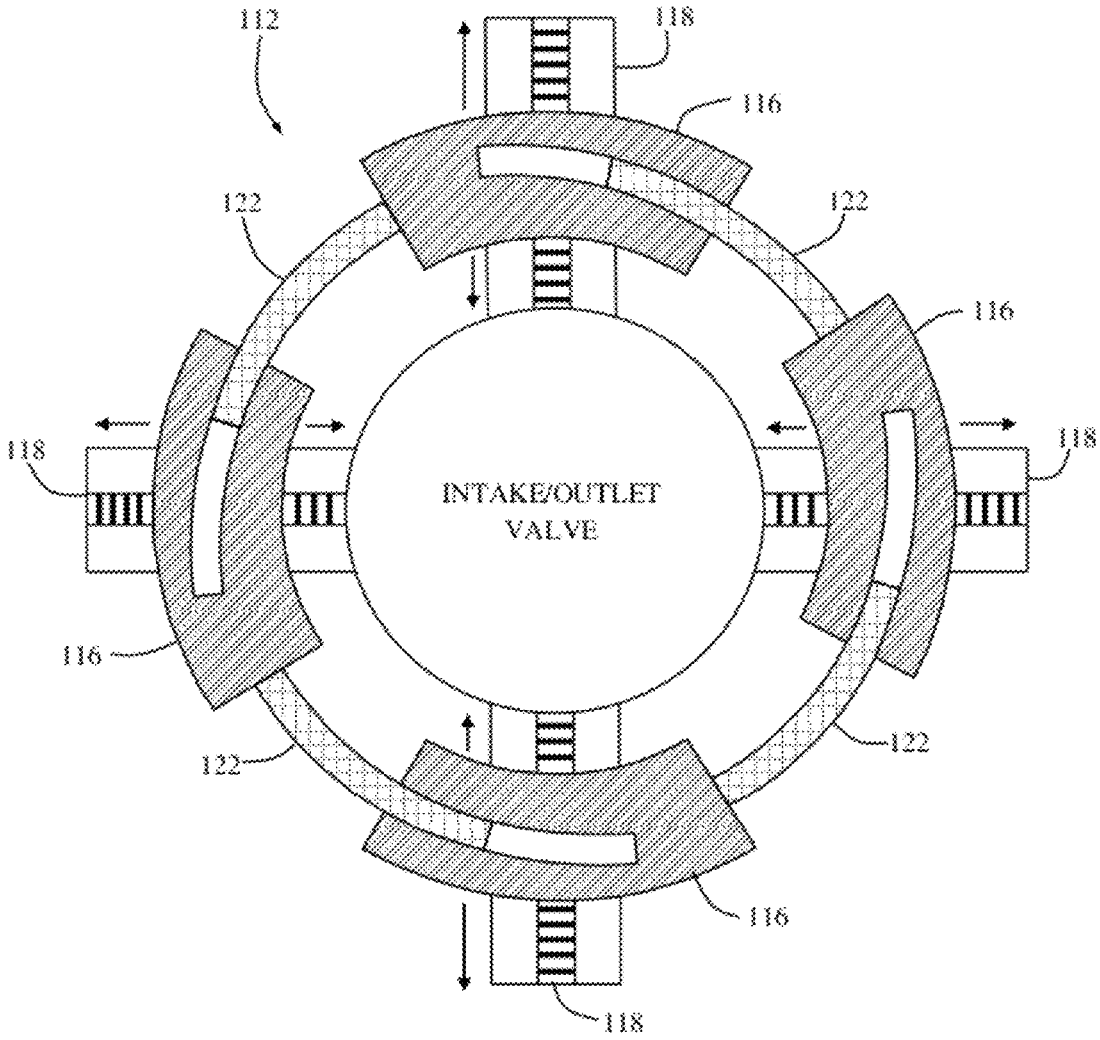
FIG. 6 is an partial cross-sectional view of the linear pump of FIG. 4 taken along line 4-4 of FIG. 4.

FIGS. 1-3 depict a marine transportation vehicle 10 according to one embodiment of the present invention. According to one embodiment of the present invention, this is accomplished by equipping a marine vessel or boat 12 (shown, by way of example only, having two hulls 14). The vessel 12 has one or more sets or "banks" of batteries 16 (such as the 24 volt batteries shown by way of example only) to power the various systems on the vessel. A plurality of solar cells 18 may also be provided to augment and/or supplant the battery banks 16. A computer guidance system 20 may also be provided for guiding and operating the various systems on the vessel 12. Also provided is an antenna 22 for sending and/or receiving data or signals from or to the various systems on the vessel 12. A plurality of sensors 24 may also be employed for providing feedback or input to the various systems on the vessel 12. A motor 26 is coupled to the vessel 12 which, in one embodiment, is capable of being swiveled between a drive position shown and a stability-providing position (not shown, approximately 90 degrees from the drive position). One or more rudders 28 are provided for steering the vessel 12.

In a preferred embodiment, the motor 26 comprises a linear pump that produces power on all strokes and allows full six degrees of freedom (6DOF) vectoring for rapid and efficient directional control. There are very few parts thereby significantly reducing the maintenance, life cycle cost, energy consumption, weight, and volume. By way of example only, the linear pump may be of a type generally shown and described in U.S. Pat. Nos. 6,352,455 and 6,607,368, the entire contents of which are hereby incorporated into this disclosure as if set forth in their entirety herein.

Figure 14:
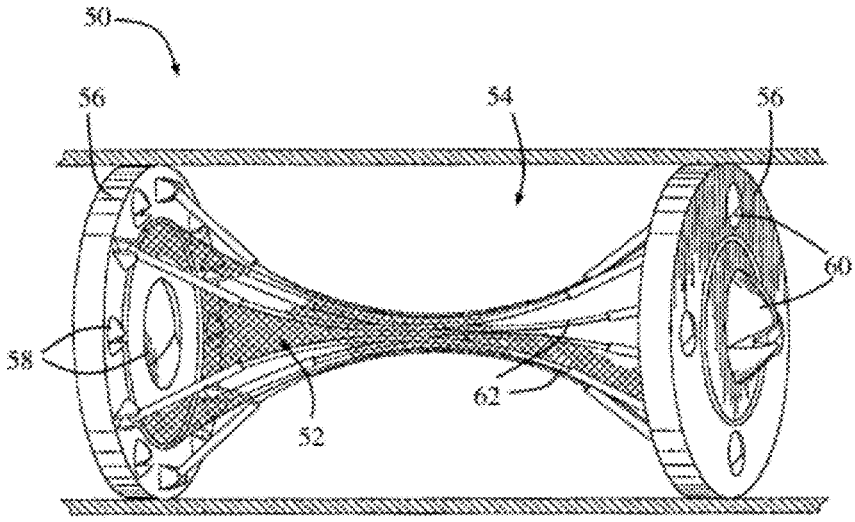
FIG. 14 is a perspective view of a prior art linear pump having a flexible inner chamber, the pump presented in partial cross-section in a condensed bladder configuration, such as after discharging fluid from the inner chamber of the bladder.
Figure 15:
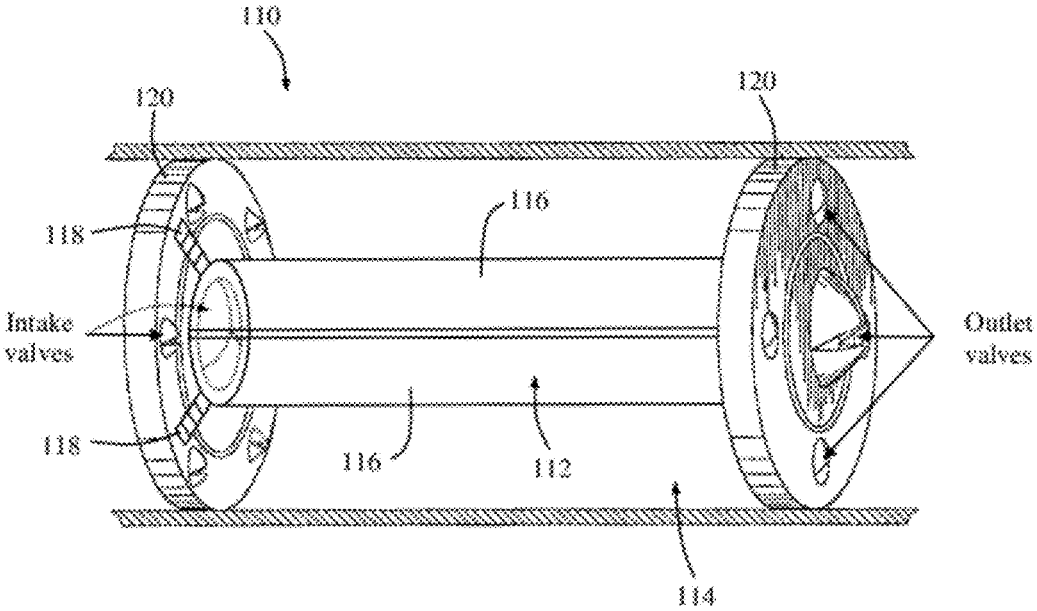
FIG. 15 is a perspective view of the linear pump of FIG. 10 after modification to include a generally rigid inner chamber of the present invention.

Referring now to FIG. 14, there is shown a depiction of a linear pump 50 as shown and described in detail in U.S. Pat. No. 6,607,368. The linear pump 50 includes an inner chamber 52 and an outer chamber 54. The linear pump 50 also includes end plates 56 having a plurality of intake valves 58 and/or outlet valves 60. Notably, the linear pump 50 further includes a plurality of flexible rib members 62 such that inner chamber comprises a flexible bladder which will stretch and recover.

FIGS. 4-8 and 15 depict a linear pump 110 according to an embodiment of the present invention. The linear pump 110 of the present invention is similar to the linear pumps of the '455 and '368 patents in that it includes an inner chamber 112 disposed within an outer chamber 114, each having one or more inlets and outlets for passing fluid into and out of each respective chamber to pump fluid. The linear pump 110 of the present invention is different from (and improved relative to) the linear pump of the '455 and '368 patents in that the outer chamber 114 and inner chamber 112 are both generally rigid, wherein the circumference of the inner chamber 112 may be adjusted via a plurality of generally rigid ribs 116 and linear motors 118, and wherein the end plates 120 do NOT move relative to one another. The linear pump of the present invention may find use in any number of fluid pumping and/or vehicle propulsion applications, including but not limited to pumping water, air, etc. . . . for any of a variety of marine, medical, industrial, governmental and/or recreational uses.

In one embodiment, the outer chamber 114 of linear pump 110 is generally rigid, and includes a plurality of intake ports 115 to permit fluid to enter into the outer chamber 114 (including but not limited to one-way check valves) and a plurality of outlet ports to permit movement of the fluid or relative fluid of the device (including but not limited to one-way check valves). The inner chamber 112 is constructed from a plurality of generally rigid plate members or "slat-like" ribs 116 which run the length of the pumping system of the present invention. Each rib member 116 cooperates with one or more linear motors 118 such that the rib members 116 may be selectively forced in a radial (i.e. outward) direction and medial (i.e. inward) direction.

Figure 7:
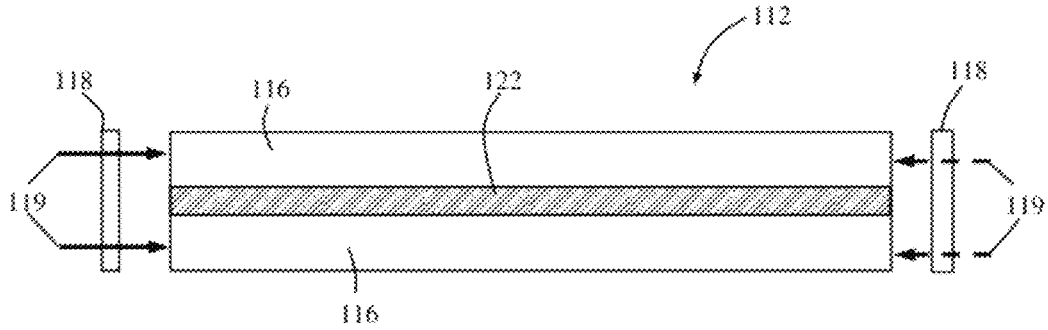
FIG. 7 is an exploded view of a rib member forming part of the inner chamber of the linear pump of FIG. 4.
Figure 8:
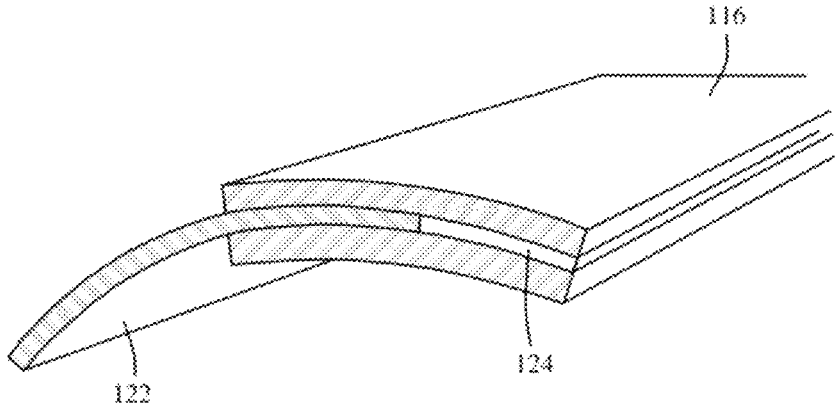
FIG. 8 is a perspective view of a rib member forming part of the inner chamber of the linear pump of FIG. 4.
Figure 9:
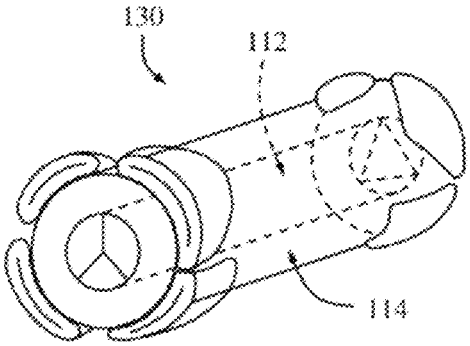
FIG. 9 is a perspective view of a linear pump according to an alternative embodiment of the present invention.

To facilitate this radial and medial motion, each rib member 116 is equipped with an articulating member 122 which engages into a groove 124 formed within an adjacent rib member 116 and forms an articulated joint. As an example, both the rib members 116 and the articulating members 122 are generally curved such that the inner chamber 112 is generally cylindrical. As the linear motors 118 are operated, the rib members 116 are caused to expand and contract within the generally rigid outer chamber 114 such that actuation of the linear motors 118 causes the circumference of the inner chamber 112 to either increase or decrease along a longitudinal axis. In a preferred embodiment, the linear motors 118 include permanent magnets, but any of a variety of suitable linear drive mechanisms may be employed without departing from the scope of the present invention, including but not limited to hydraulic and pneumatic systems. To ensure no pressure loss during operation, the articulating member may be equipped with any of a variety of sealing features, including but not limited to O-rings or the like to prevent the passage of fluid in between the adjacent rib members 116 during contraction and/or expansion. As illustrated in FIG. 7, the rib members 116 may be attached to the linear motors (by way of example only) by recessed screws 119 inserted into either end of the rib member 116.

One advantage of this design is that, unlike the linear pump systems shown and described in the '455 or '368 patents, the inner chamber 112 is not a bladder which will stretch and recover. The power is 90-degree opposition, which provides close to a 100% power exchange instead of the 70% with the flexible bladder of the '455 or '368 patents. This is a significant distinction in that it will allow the pump 110 of the present invention, when attached to a vehicle or appropriate size and construction, to actually propel the vehicle from a position on top of or under the water to an airborne state out of the water.

Figure 10:
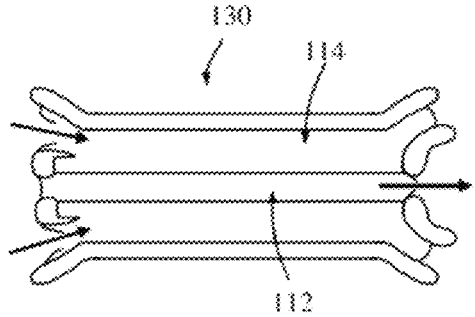
FIG. 10 is a side cross-sectional view of the linear pump of FIG. 9 illustrating the simultaneous inner chamber fluid discharge and outer chamber fluid charge according to the present invention.
Figure 11:
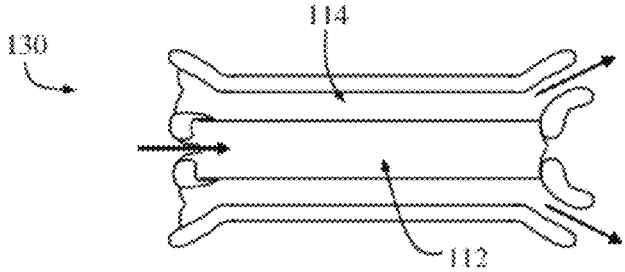
FIG. 11 is a side cross-sectional view of the linear pump of FIG. 9 illustrating the simultaneous outer chamber fluid discharge and inner chamber fluid charge according to the present invention.

FIGS. 9-13 illustrate the use of a linear pump 130 according to an alternative embodiment of the present invention. The main difference between linear pump 130 and linear pump 110 of FIGS. 4-8 is that the outer chamber 114 of linear pump 130 has inlets and outlets disposed along the outer periphery of the outer chamber 114. As shown in FIG. 10, linear pump 130 (along with linear pump 110) is capable of simultaneously discharging the fluid within the inner chamber 112 while fluid is charged or delivered into the outer chamber 114 according to the present invention. The inverse is also true, as shown in FIG. 11, wherein the linear pump 130 (as well as linear pump 110) is capable of simultaneously discharging the fluid within the outer chamber 114 while fluid is charged or delivered into the inner chamber 112 according to the present invention.

Figure 12:
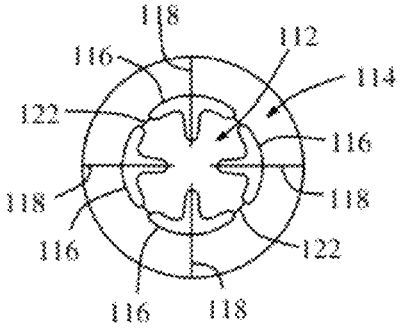
FIG. 12 is a side view of the linear pump of FIG. 9 illustrating the inner chamber in a contracted state.
Figure 13:
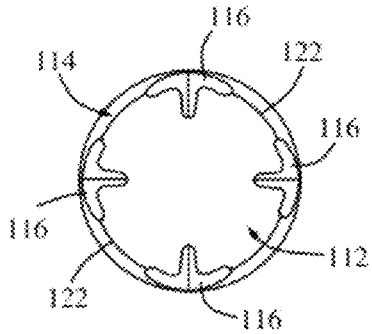
FIG. 13 is a side view of the linear pump of FIG. 9 illustrating the inner chamber in an expanded state.

FIG. 12 is a side view of the linear pump 130 illustrating the inner chamber 112 in a contracted state. FIG. 13 is a side view of the linear pump 130 illustrating the inner chamber 112 in an expanded state.

Although described herein as suitable for unmanned use, it will be appreciated that the marine vessel of the present invention may also be equipped to be manned with one or more users.

The marine vehicle 10 of the present invention, including any or all its constituent parts, may be dimensioned in any size depending upon the application.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined herein and claimed below.

What is claimed is:

1. A marine transportation system, comprising:

a vessel capable of progressing through water; and a linear pump including a generally rigid outer chamber having at least one fluid inlet and at least one fluid outlet and an inner chamber disposed within said outer chamber, said inner chamber having at least one fluid inlet and at least one fluid outlet and comprising a plurality of generally rigid articulating walls coupled together via articulating joints to provide bi-directional radial movement of said walls to expand and contract the volume of fluid within said inner chamber and at least one linear motor disposed proximate each end of the inner chamber and coupled to at least one of said plurality of generally rigid articulating walls such that actuation of said linear motor causes said bi-directional radial movement of said walls such that a circumference of said inner chamber at least one of increases and decreases along a longitudinal axis to facilitate the simultaneous influx of fluid through said at least one fluid inlet of said inner chamber and expulsion of fluid through said at least one fluid outlet of said outer chamber, said linear pump coupled to said vessel for propelling said vessel through said water.

2. The marine transportation system of claim 1, wherein said bi-directional radial movement of said walls further facilitates the simultaneous influx of fluid through said at least one fluid inlet of said outer chamber and expulsion of fluid through said at least one fluid outlet of said inner chamber.

3. The marine transportation system of claim 1 and further, wherein said vessel is dimensioned to progress substantially above the surface of said water.

4. The marine transportation system of claim 1 and further, wherein said linear pump is coupled to said vessel via a swivel arrangement capable of positioning said linear pump to provide at least two degrees of directional control.

5. The marine transportation system of claim 1 and further, comprising a power supply system including at least one battery for supplying power to said linear pump.

6. The marine transportation system of claim 1 and further, comprising a power supply system including at least one solar cell for supplying power to said linear pump.

7. The marine transportation system of claim 1 and further, comprising a computer guidance system for guiding and operating said linear pump.

8. The marine transportation system of claim 1 and further, comprising at least one sensor for providing feedback to said linear pump.

9. The marine transportation system of claim 1 and further, wherein said vessel is equipped with at least one seat for carrying a passenger.

10. The marine transportation system of claim 1 and further, comprising at least one antenna for at least one of sending signals from said vessel and receiving signals on said vessel.

11. A method of providing marine transportation, comprising:

equipping a vessel capable of progressing through water with a linear pump capable of propelling said vessel through said water, said linear pump including a generally rigid outer chamber having at least one fluid inlet and at least one fluid outlet and an inner chamber disposed within said outer chamber, said inner chamber having at least one fluid inlet and at least one fluid outlet and comprising a plurality of generally rigid articulating walls coupled together via articulating joints to provide bi-directional radial movement of said walls to expand and contract the volume of fluid within said inner chamber and at least one linear motor disposed proximate each end of the inner chamber and coupled to at least one of said plurality of generally rigid articulating walls such that actuation of said linear motor causes said bi-directional radial movement of said walls such that a circumference of said inner chamber at least one of increases and decreases along a longitudinal axis to facilitate the simultaneous influx of fluid through said at least one fluid inlet of said inner chamber and expulsion of fluid through said at least one fluid outlet of said outer chamber.

12. The marine transportation system of claim 11, wherein said bi-directional radial movement of said walls further facilitates the simultaneous influx of fluid through said at least one fluid inlet of said outer chamber and expulsion of fluid through said at least one fluid outlet of said inner chamber.

13. The method of providing marine transportation of claim 11 and further, including the sub-step of dimensioning said vessel to progress substantially above the surface of said water.

14. The method of providing marine transportation of claim 11 and further, including the sub-step of coupling said linear pump to said vessel via a swivel arrangement capable of positioning said linear pump to provide at least two degrees of directional control.

15. The method of providing marine transportation of claim 11 and further, including the step of providing a power supply system including at least one battery for supplying power to said linear pump.

16. The method of providing marine transportation of claim 11 and further, including the step of providing a power supply system including at least one solar cell for supplying power to said linear pump.

17. The method of providing marine transportation of claim 11 and further, including the step of providing a computer guidance system for guiding and operating said linear pump.

18. The method of providing marine transportation of claim 11 and further, including the step of providing at least one sensor for providing feedback to said linear pump.

19. The method of providing marine transportation of claim 11 and further, including the sub-step of equipping said vessel with at least one seat for carrying a passenger.

20. The method of providing marine transportation of claim 11 and further, including the step of providing at least one antenna for at least one of sending signals from said vessel and receiving signals on said vessel.

* * * * *